US007962975B2

(12) United States Patent
Hartline et al.

(10) Patent No.: US 7,962,975 B2
(45) Date of Patent: Jun. 21, 2011

(54) MECHANISM FOR MOUNTING A FOLDABLE-BED UNIT IN AN ARTICLE OF FURNITURE

(75) Inventors: Michael F. Hartline, Saltillo, MS (US); Kenneth R. Graham, Tupelo, MS (US)

(73) Assignee: L & P Property Management Company, South Gate, CA (US)

( * ) Notice: Subject to any disclaimer, the term of this patent is extended or adjusted under 35 U.S.C. 154(b) by 71 days.

(21) Appl. No.: 12/575,868

(22) Filed: Oct. 8, 2009

(65) Prior Publication Data

US 2011/0083265 A1 Apr. 14, 2011

(51) Int. Cl.
*A47C 17/00* (2006.01)

(52) U.S. Cl. ..... 5/51.1; 5/279.1; 5/32.1; 5/12.1; 297/118; 297/440.1

(58) Field of Classification Search ..... 5/279.1, 5/51.1, 57.1, 32.1, 12.1; 297/105, 118, 440.14, 297/440.1

See application file for complete search history.

(56) References Cited

U.S. PATENT DOCUMENTS 4,045,829 A * 9/1977 Pringle ..... 5/18.1
4,435,860 A * 3/1984 Talley et al. ..... 5/13
6,231,120 B1 * 5/2001 Wiecek ..... 297/84
6,241,317 B1 * 6/2001 Wu ..... 297/440.23
6,752,464 B1 * 6/2004 Tseng ..... 297/440.16
7,641,277 B2 * 1/2010 Lawson et al. ..... 297/85 L
7,735,914 B2 * 6/2010 Longnecker ..... 297/125
2002/0093235 A1 * 7/2002 Niederman et al. ..... 297/440.1
2007/0278837 A1 * 12/2007 White et al. ..... 297/362.13
2010/0269255 A1 * 10/2010 Kanthasamy ..... 5/37.1

* cited by examiner

*Primary Examiner* — Robert G Santos
*Assistant Examiner* — Brittany M Wilson
(74) *Attorney, Agent, or Firm* — Shook, Hardy & Bacon LLP

(57) ABSTRACT

A mechanism for mounting a foldable-bed unit in an article of furniture is described. A pair of mounting plates each including a first and second bracket is mounted on opposite ends of a cavity in the article of furniture. The brackets include a U-shaped slot configured to accept a fixture having an enlarged head. A retaining tab is included within one or more of the brackets to retain the fixture therein. The first brackets are located rearwardly of the second brackets and at an angle such that the slot therein is tilted forwardly. The second brackets are oriented to provide a generally vertical orientation to the slots therein. A foldable-bed unit having fixtures corresponding to each of the brackets is installed into the article of furniture by inserting corresponding fixtures into the first brackets. The foldable-bed unit is rotated to insert the remaining fixtures into the second brackets.

20 Claims, 6 Drawing Sheets

MECHANISM FOR MOUNTING A FOLDABLE-BED UNIT IN AN ARTICLE OF FURNITURE

BACKGROUND

Modern furniture has been designed with various configurable components to provide added comfort, value, and integration of multiple types of furniture into a single article. One example of such integration is the sofa-sleeper. The sofa-sleeper provides a standard sofa seating surface with a bed or sleeping surface folded up and hidden within the sofa. The bed may be extended from a folded position when needed to provide temporary sleeping accommodations for guests and the like.

The foldable-bed units used in sofa-sleepers are heavy and cumbersome to handle during manufacturing of the sofa-sleeper. The units must be installed in a sofa-sleeper by mounting to the internal frame of the sofa during manufacturing. The units are typically bolted or screwed to wooden structural members within the sofa. This typically requires multiple operators and various manipulations of the foldable-bed unit to support the hefty and cumbersome unit and to gain access to the required locations for inserting the necessary bolts or screws. Thus, the installation of foldable-bed units is labor intensive and may produce a bottleneck in manufacturing operations.

SUMMARY

Embodiments of the invention generally relate to a mechanism and method for installing a foldable-bed unit in an article of furniture. A pair of mounting plates is affixed to the frame of an article of furniture on opposing sides of a cavity in which a foldable-bed unit will be installed. The mounting plates each include a pair of brackets having a U-shaped slot therein for accepting a rivet associated with the foldable-bed unit. A first of the brackets is mounted nearer the rear of the article of furniture and is oriented at an angle such that the open upper end of the U-shaped slot is angled toward the front of the article of furniture. A second of the brackets is mounted forwardly of the first bracket and is oriented generally vertically. As such, corresponding rivets of the foldable-bed unit are inserted first into the angled slots of the first brackets and then the foldable-bed unit rotated to insert corresponding rivets into the vertically oriented slots of the second brackets. A retaining tab may be included within one or more of the brackets to secure the rivet therein. Thus, the foldable-bed unit can be installed in the article of furniture in a folded condition without requiring any tools or access to bolting locations during the installation process.

This Summary was provided to introduce a selection of concepts in a simplified form that are further described below in the Detailed Description. This Summary is not intended to identify key features or essential features of the claimed subject matter, nor is it intended to be used in isolation as an aid in determining the scope of the claimed subject matter.

DESCRIPTION OF THE DRAWINGS

Illustrative embodiments of the invention are described in detail below with reference to the attached drawing figures, wherein.

DETAILED DESCRIPTION

Figures 1, 2:
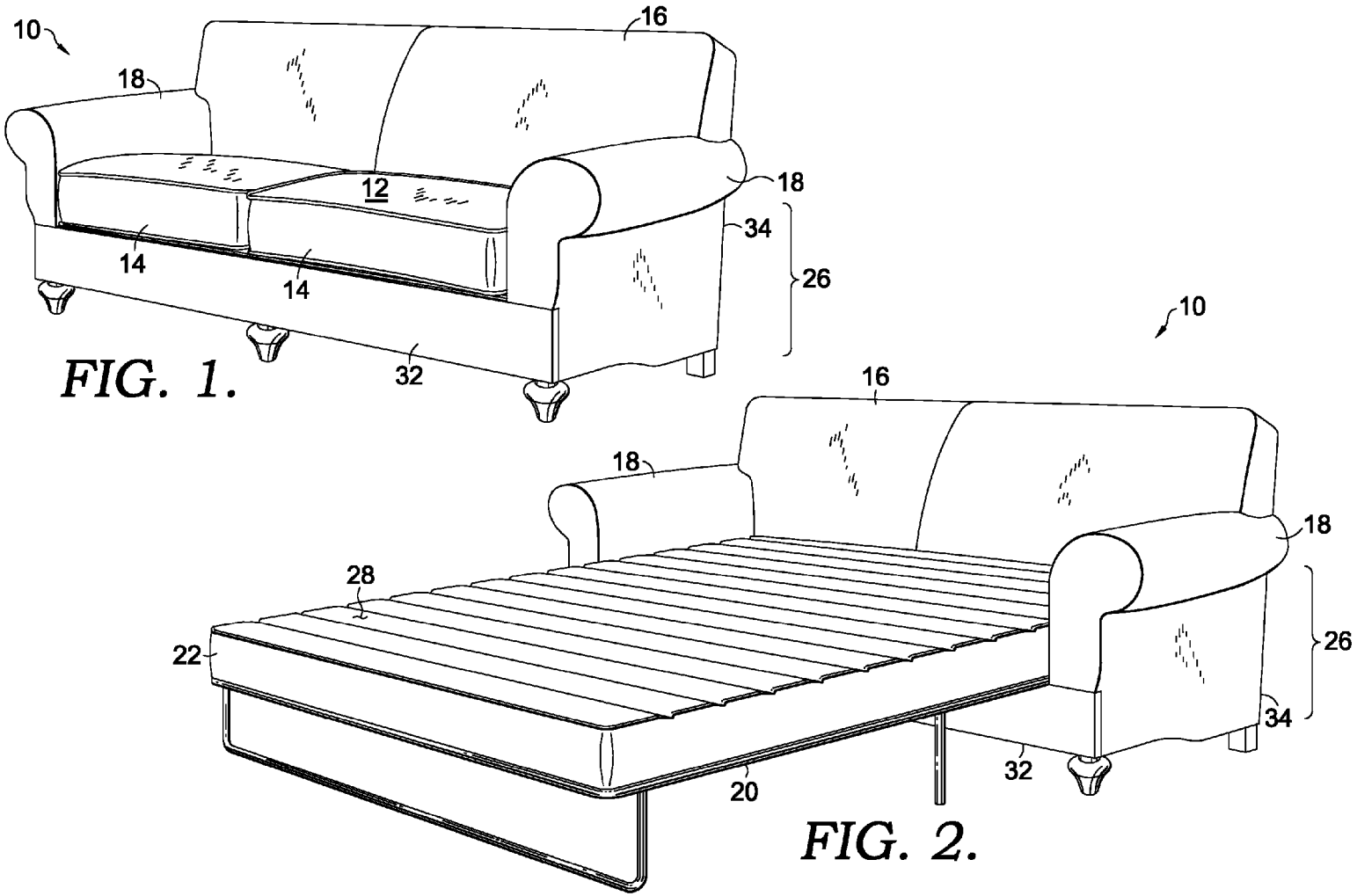
FIG. 1 is a perspective view of a sofa-sleeper in a seating configuration in accordance with an embodiment of the invention.
FIG. 2 is a perspective view of a sofa-sleeper with a foldable-bed unit in an extended position in accordance with an embodiment of the invention.

The subject matter of embodiments of the invention is described with specificity herein to meet statutory requirements. However, the description itself is not intended to limit the scope of this patent. Rather, the inventors have contemplated that the claimed subject matter might also be embodied in other ways, to include different components or combinations of components similar to the ones described in this document, in conjunction with other present or future technologies.

Embodiments of the invention include a mechanism and method for mounting a foldable-bed unit in an article of furniture, as well as an article of furniture having a foldable-bed unit mounted therein. In one embodiment, a quick-mount mechanism for mounting a foldable-bed unit into an article of furniture is disclosed. The mechanism includes a pair of mounting plates fixedly coupled to opposing interior surfaces of a frame of an article of furniture. Each of the mounting plates includes a first bracket and a second bracket. The first and second brackets have a U-shaped slot configured to slideably receive a corresponding fixture associated with a foldable-bed unit. The first bracket is mounted rearwardly of the second bracket on the mounting plate and is oriented such that the U-shaped slot therein has a non-vertical orientation with respect to the upright position of the article of furniture. The second bracket is mounted forwardly of the first bracket and is oriented such that the U-shaped slot therein has a generally vertical orientation with respect to the upright position of the article of furniture.

In another embodiment a method for installing a foldable-bed unit in an article of furniture is described. A pair of mounting plates is mounted on opposing interior surfaces of a frame of an article of furniture. Each of the mounting plates includes a first bracket and a second bracket. The first and second brackets have a U-shaped slot configured to slideably receive a corresponding fixture associated with a foldable-bed unit. The first bracket is mounted rearwardly of the second bracket on the mounting plate and is oriented such that the U-shaped slot therein has a non-vertical orientation with respect to an upright position of the article of furniture. The second bracket is mounted forwardly of the first bracket and is oriented such that the U-shaped slot therein has a generally vertical orientation with respect to the upright position of the article of furniture. A pair of first fixtures of the foldable-bed unit is slideably inserted into the U-shaped slots of the first brackets. The foldable-bed unit is rotated about an axis formed by the first fixtures toward the second brackets. A pair of second fixtures of the foldable-bed unit is slideably inserted into the U-shaped slots of the second brackets.

In another embodiment, an article of furniture having a quick-mount mechanism for mounting a foldable-bed unit therein is provided. The article of furniture includes a frame providing two cross-members located near opposite ends of the article of furniture. The cross-members extend from a front portion to a rear portion of the article of furniture and define ends of a cavity therein. A first bracket and a second bracket are attached to each of the cross-members on opposing faces of the cross-members and interior to the cavity. The first and second brackets include a raised U-shaped slot having an open upper end configured to slideably accept a fixture of a foldable-bed unit. The first bracket is mounted rearwardly of the second bracket on the cross-member and is oriented such that the open upper end of the U-shaped slot therein is angled toward the second bracket. The second bracket is mounted forwardly of the first bracket and is oriented such that the U-shaped slot therein has a generally vertical orientation with respect to an upright position of the article of furniture. Each of the first and second brackets further includes a retaining tab located interior to the U-shaped slots of the first and second brackets. A foldable-bed unit that includes a pair of first fixtures corresponding to each of the first brackets, and a pair of second fixtures corresponding to each of the second brackets, is also included. Each fixture has a configuration suitable to slideably couple to the corresponding first and second brackets. The foldable-bed unit is installed in the cavity by slideably inserting the pair of first fixtures into the U-shaped slots of the first brackets to engage any retaining tabs therein and rotating the foldable-bed unit about an axis created by the first fixtures to slideably insert the pair of second fixtures into the U-shaped slots of the second brackets and engage any retaining tabs therein.

Embodiments of the invention are described herein with respect to a sofa or a sofa-sleeper, such terms being used interchangeably herein. However, embodiments of the invention are useable with other articles of furniture such as a chair, a chair-and-a-half, a recliner, a loveseat, or any other article of furniture in which a foldable-bed unit might be installed. Additionally, a foldable-bed unit includes any foldable-bed unit, sleeper mechanism, hide-away-bed unit, or the like that can be configured to provide fixtures for slideably coupling to brackets as described below.

With reference now to the drawings, and to FIG. 1 in particular, a sofa-sleeper 10 is described in accordance with an embodiment of the invention. The sofa-sleeper 10 includes a seating surface 12 including one or more cushions 14, a backrest 16, a pair of armrests 18, and a foldable-bed unit (not shown) folded and tucked into the sofa 10 beneath the cushions 14. As depicted in FIG. 2, the cushions 14 may be removed and a foldable-bed unit 20 having a mattress 22 thereon may be extended from a cavity 24 within the base 26 of the sofa 10 to provide a sleeping surface 28.

Figure 3A:
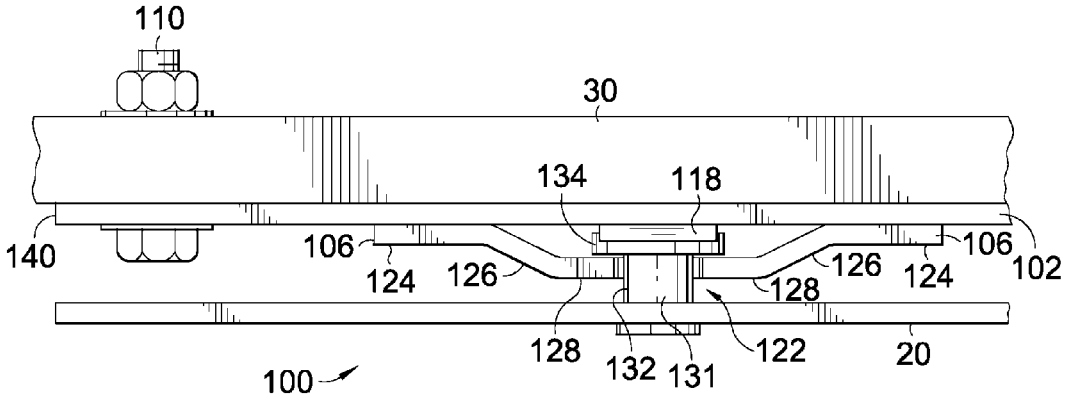
FIG. 3A is an overhead plan view of a portion of a quick-mount mechanism in accordance with an embodiment of the invention.
Figure 3B:
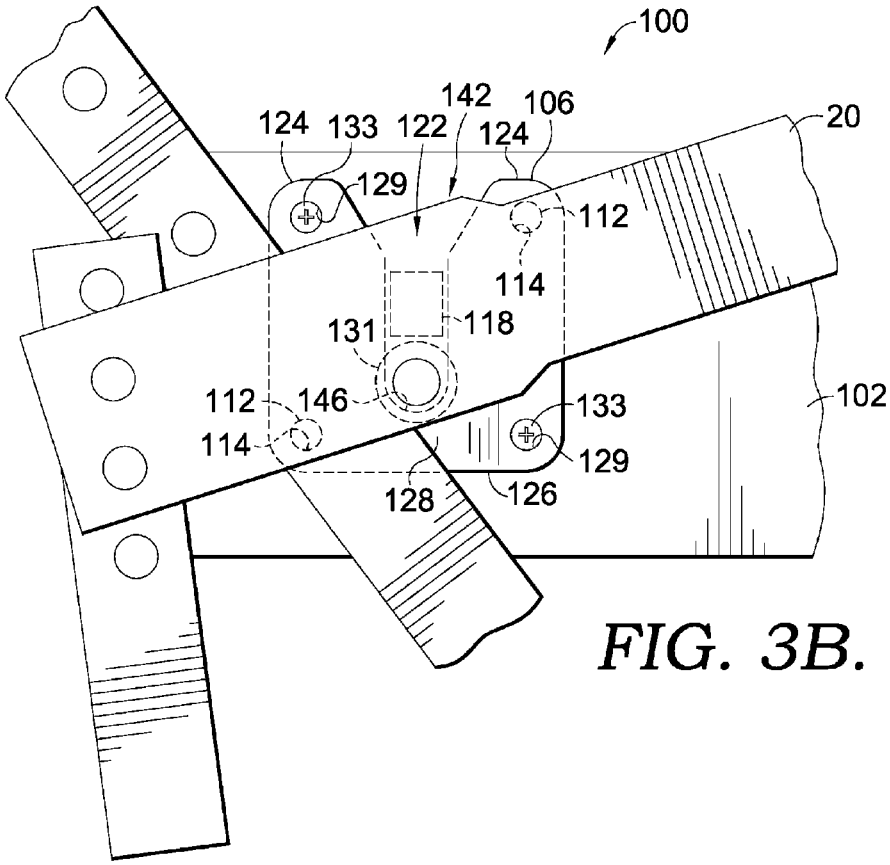
FIG. 3B is an elevational view of a bracket of a quick-mount mechanism depicting a fixture of a foldable-bed unit retained therein in accordance with an embodiment of the invention.
Figure 4:
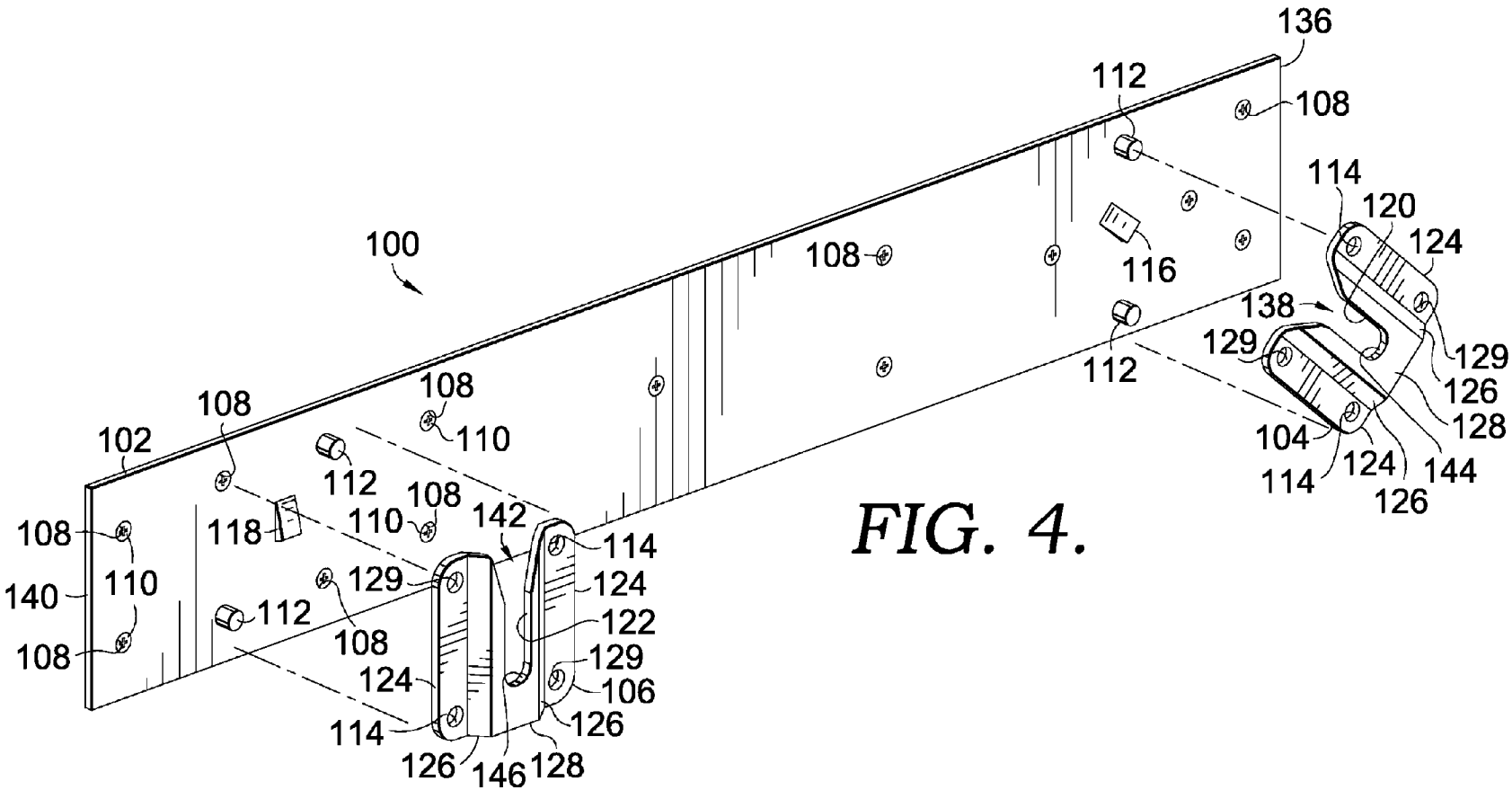
FIG. 4 is a perspective exploded view of a quick-mount mechanism in accordance with an embodiment of the invention.
Figure 5:
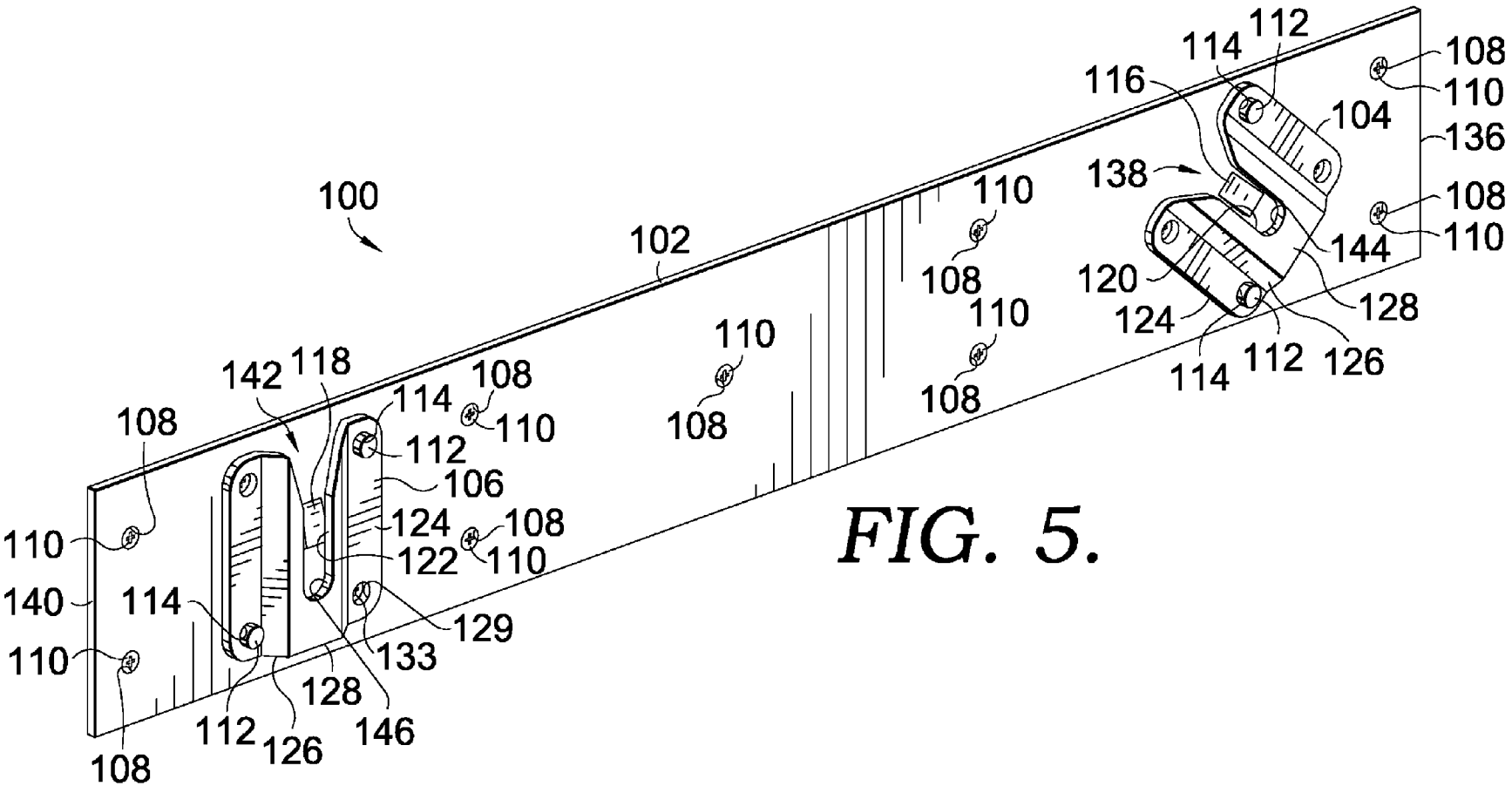
FIG. 5 is a perspective view of a quick-mount mechanism in accordance with an embodiment of the invention.

The foldable-bed unit 20 is mounted to a cross-member 30 of the frame (see FIG. 3) of the sofa 10 at each end of the cavity 24. The cross-members 30 extend from near a front portion 32 toward a rear portion 34 of the sofa 10 and define ends of the cavity 24. The cross-members 30 provide structural support for the frame of the sofa 10 and support at least a portion of the foldable-bed unit 20 when in a folded position (FIG. 1), an extended position (FIG. 2), and when in transition therebetween.

With reference now to FIGS. 3-6, a quick-mount mechanism 100 for installing the foldable-bed unit 20 in the sofa-sleeper 10 is described in accordance with an embodiment of the invention. The components of the quick-mount mechanism 100 are produced from sheet steel and steel rod by stamping, machining, and hot or cold forming, but may be produced from any desired materials and by any available manufacturing methods without departing from the scope of the invention. Further, the components of the sofa 10, excluding the components of the quick-mount mechanism 100 described herein, are produced from wood and textile construction as is known in the art, but may employ any desired materials and manufacturing techniques without departing from the scope of embodiments of the invention.

The quick-mount mechanism 100 (hereinafter the "mechanism") includes a mounting plate 102, a first bracket 104, and a second bracket 106. The mounting plate 102 comprises a generally rectangular section of sheet steel having dimensions compatible with the cross-member 30 of the frame of the sofa 10. The mounting plate 102 may be equal in dimension to a surface of the cross-member 30 on which the mounting plate 102 is affixed, but typically is somewhat smaller than the surface and fits within the boundary thereof. In another embodiment, the mounting plate 102 wraps around or is integral with the cross-member 30. The mounting plate 102 is mounted generally horizontally or parallel with a floor surface upon which the sofa 10 sits when in an upright position.

The mounting plate 102 includes a plurality of apertures 108 through which a fastener 110 is inserted to attach the mounting plate 102 to the cross-member 30. The fasteners 110 include any fasteners available in the art such as, for example and not limitation, bolts, screws, and nails. The mounting plate 102 also includes two pairs of locating pins 112 that extend outwardly from the surface of the mounting plate 102 and aid in properly locating the first and second brackets 104, 106 on the mounting plate 102 during manufacture. The locating pins 112 have dimensions suitable to be received by corresponding apertures 114 of the first and second brackets 104, 106. Alternative features such as tabs, channels, groves, lips, and the like may be used in addition to or instead of the locating pins 112 to properly locate the first and second brackets 104, 106 on the mounting plate 102 or another method that does not employ such features may be employed.

The mounting plate 102 also includes a first and second retaining tab 116, 118 extending from the surface thereof. The first retaining tab 116 is located on the mounting plate 102 to align with a first slot 120 in the first bracket 104 when the bracket 104 is mounted on the mounting plate 102. The second retaining tab 118 is located so as to align with a second slot 122 of the second bracket 106. The first and second retaining tabs 116, 118 are formed by cutting an outline of the tabs 116, 118 and bending a portion thereof outwardly from the surface of the mounting plate 102. In another embodiment, the mounting plate 102 is configured to accept a spring clip (not shown) that is installed on the mounting plate 102 and provides a structure and function similar to the first and second retaining tabs 116, 118. The operation of the first and second retaining tabs 116, 118 is described more fully below.

The first bracket 104 includes a pair of base portions 124, a pair of shoulder portions 126, and a raised portion 128. The base portions 124 extend along each side of the first bracket 104 and provide a region for mounting the first bracket 104 on the mounting plate 102. The base portions 124 include a pair of apertures 114 for accepting the locating pins 112 of the mounting plate 102 as described above as well as a second pair of apertures 129 through which fasteners 133 are inserted to fasten the first bracket 104 to the mounting plate 102. In another embodiment, the apertures 129 are not included and the first bracket 104 is affixed to the mounting plate 102 by another method, such as by welding.

The raised portion 128 extends parallel to and between the base portions 124 and is spaced apart from the mounting plate 102 by the shoulder portions 126. The raised portion 128 includes the first slot 120 having a U-shape with dimensions suitable for accepting a first or second fixture 130, 131 having an enlarged head therein. The fixtures 130, 131 include a neck 132 and a head 134, the head 134 having a greater diameter than the neck 132. Thus, the first slot 120 has a sufficient width to accept the neck 132 of the fixture 130, 131 but the width is narrower than the diameter of the head 134. The shoulder portions 126 provide sufficient spacing between the raised portion 128 and the mounting plate 102 to allow the head 134 of the fixture 130, 131 to fit therebetween. The fixtures 130, 131 comprise any suitable fixture available in the art such as, for example and not limitation, a rivet, a flat-head shoulder rivet, or a rod, dowel, bar, or lug having an enlarged head, among others.

The first bracket 104 is mounted on the mounting plate 102 at a location adjacent a rear end 136 of the mounting plate 102 that is nearest the rear portion 34 of the sofa 10. The first bracket 104 is oriented such that an axis along the length of the first slot 120 therein is tilted toward the front portion 32 of the sofa 10 with an open end 138 of the first slot 120 directed generally upward. The angle of the tilt of the first slot 120 is any desired angle between vertical and horizontal and is generally approximately 45° (forty-five degrees). In another embodiment, the first bracket 104 is tilted toward the rear portion 34 of the sofa 10.

The second bracket 106 is configured similarly to that of the first bracket 104 and includes base portions 124, shoulder portions 126, the raised portion 128, as well as the apertures 114 and 129, and the U-shaped second slot 122. The second bracket 106 is mounted on the mounting plate 102 adjacent to a front end 140 of the mounting plate 102 nearest to the front portion 32 of the sofa 10 and spaced generally horizontally apart from the first bracket 104. The second bracket 106 is oriented such that an axis along the length of the second slot 122 has a generally vertical orientation with an open end 142 of the second slot 122 directed generally upward. It is to be understood that various other bracket designs can be employed in embodiments of the invention without departing from the scope thereof.

With additional reference now to FIGS. 6A-D, the operation of the mechanism 100 is described. Initially, the first and second brackets 104, 106 are placed on the mounting plate 102 by inserting the locating pins 112 into corresponding apertures 114 on the first and second brackets 104, 106. The first and second brackets 104, 106 are fastened to the mounting plate by fasteners 133 inserted through the apertures 129 or by welding along the outer edges of the base portions 124 of the first and second brackets 104, 106. A pair of mounting plates 102 is coupled to opposing faces of the cross-members 30 in the sofa 10 by installing fasteners 110 in apertures 108 of the mounting plate 102. In another embodiment the mounting plate 102 is omitted and the first and second brackets 104, 106 are directly attached to the cross-members 30. In such an embodiment the first and second retaining tabs 116, 118 are integral with the first and second brackets 104, 106 respectively or may be integrated in or attached to the cross-members 30.

Figure 6A:
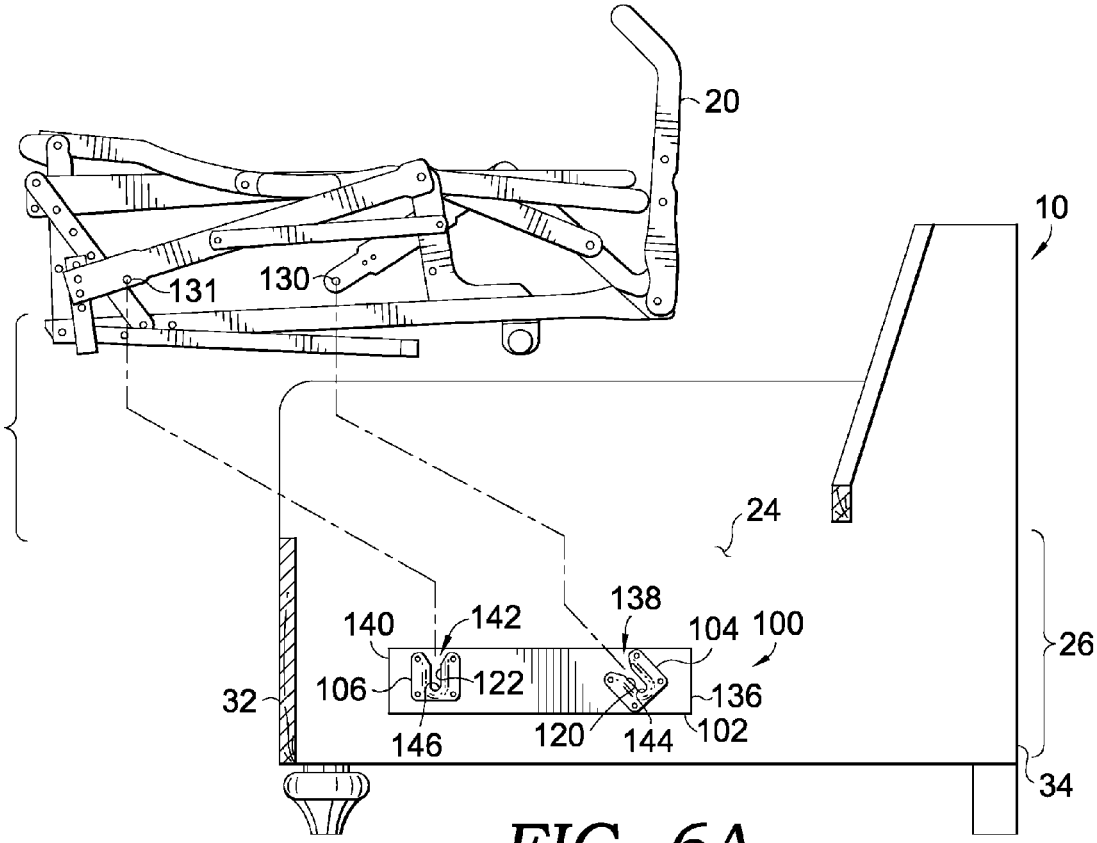
FIGS. 6A-D are elevational cutaway views of the installation of a foldable-bed unit in an article of furniture using a quick-mount mechanism in accordance with an embodiment of the invention.

As depicted in FIG. 6A the foldable-bed unit 20 is configured to include two first fixtures 130 that correspond with the first brackets 104 and two second fixtures 131 that correspond with the second brackets 106 mounted on the mounting plates 102 in the sofa 10. The foldable-bed unit 20 is also placed in a folded arrangement. Installing the foldable-bed unit 20 in a folded arrangement may provide the most compact and easiest to handle arrangement thereof for installation purposes. However, the foldable-bed unit 20 may be installed in any desired arrangement.

Figure 6B:
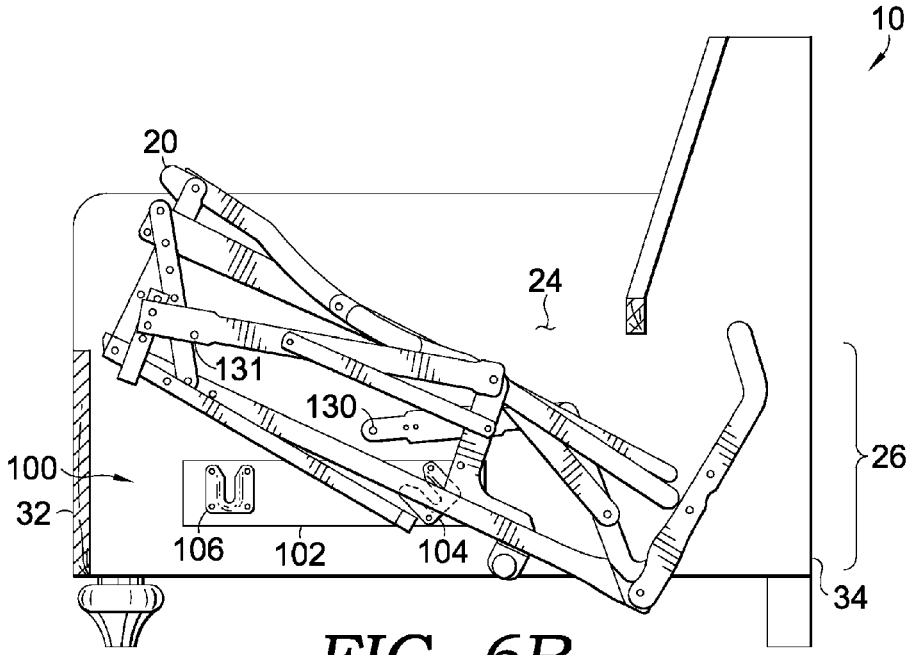
Figure 6C:
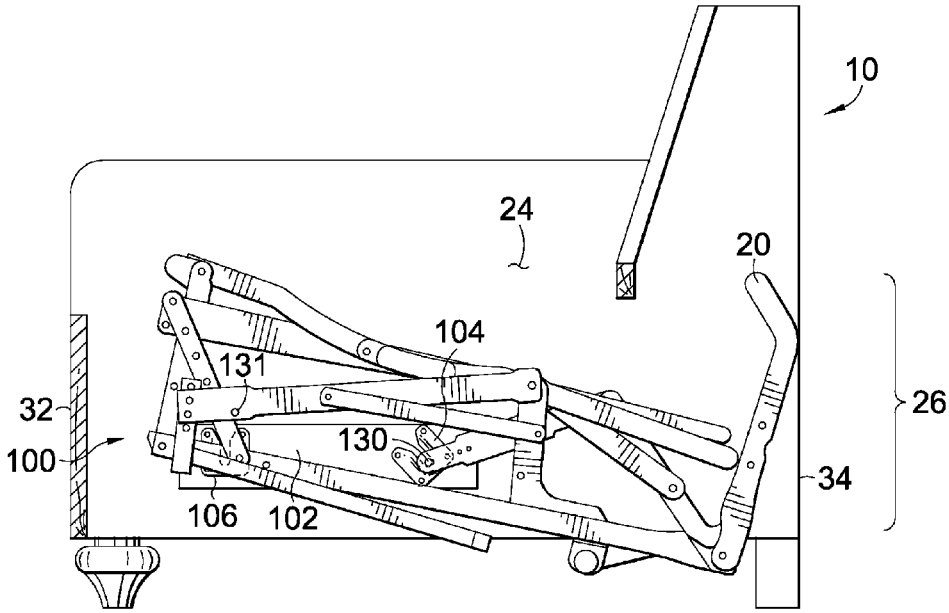

The foldable-bed unit 20 is at least partially inserted into the cavity 24 of the sofa 10 to align and slideably insert the first fixtures 130 into each of the first brackets 104, as shown in FIGS. 6B and 6C. The first fixtures 130 are accepted into the open ends 138 of the U-shaped first slots 120 of the first brackets 104 and slide or translate toward a closed end 144 of the first slots 120. As the first fixtures 130 slide within the first slots 120 the first retaining tabs 116 are compressed by the heads 134 of the first fixtures 130 toward the mounting plate 102 to allow the first fixtures 130 to pass by. After the first fixtures 130 pass the first retaining tabs 116, the first retaining tabs 116 resume their original raised position. Thereby, the first retaining tabs 116 obstruct travel of the first fixtures 130 within the first slots 120 toward the open end 138 thereof. Thus, the first fixtures 130 are retained within the first slots 120 by the first retaining tabs 116 and by the closed ends 144 of the first slots 120. The first fixtures 130 fit within the closed ends 144 of the first slots 120 with sufficient room to allow for rotational motion of the first fixtures 130.

Figure 6D:
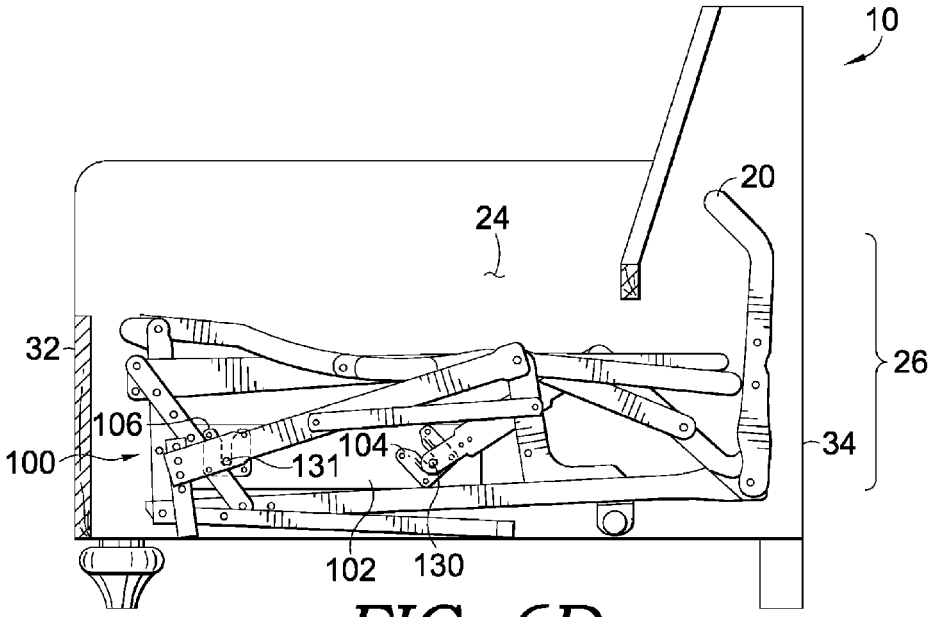

The foldable-bed unit 20 is rotated about an axis formed by the first fixtures 130 in the first brackets 104 to slideably engage the second fixtures 131 with the second slots 122 of the second brackets 106, as depicted in FIG. 6D. As described previously, the second fixtures 131 are received into the second slots 122 via the open ends 142 of the second slots 122 and translate along the second slots 122 toward closed ends 146 thereof. As such, the second fixtures 131 compress the second retaining tabs 118 as they pass over the second retaining tabs 118 and the second fixtures 131 are secured into position by the second retaining tabs 118 returning to their original position after the second fixtures 131 have passed to obstruct movement of the second fixtures 131 toward the open ends 142 of the second slots 122.

As such, the foldable-bed unit 20 is secured within the cavity 24 of the sofa 10 by interaction of the first and second fixtures 130, 131 with the first and second retaining tabs 116, 118 and the first and second brackets 104, 106. In another embodiment, the first retaining tabs 116 are not included in the first brackets 104. As such, the foldable-bed unit 20 is secured within the cavity 24 by the interaction of the second fixtures 131 and the second retaining tabs 118 of the second brackets 106 inhibiting removal of the second fixtures 131 from the second brackets 106. Further, the tilt of the first brackets 104 mechanically prohibits removal of the first fixtures 130 from the first brackets 104 without first removing the second fixtures 131 from the second brackets 106.

Manipulation and handling of the foldable-bed unit 20 for insertion into the sofa 10 may be completed by one or more operators or a crane or hoist system may be utilized. Further, the simplified installation of the foldable-bed unit 20 into the sofa 10 provided by the quick-mount mechanism 100 increases the speed and eases the installation and may be completed by a single operator. Additionally, the installation of the foldable-bed unit 20 onto pre-installed mounting plates 102 and first and second brackets 104, 106 does not require any tools or access to areas within the sofa 10 for installing fasteners and the like.

From the foregoing, it will be seen that this invention is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

What is claimed is:

1. A quick-mount mechanism for mounting a foldable-bed unit into an article of furniture comprising:

a pair of mounting plates fixedly coupled to opposing interior surfaces of a frame of an article of furniture;

each of the mounting plates including a first bracket and a second bracket, the first and second brackets including a U-shaped slot configured to slideably receive a corresponding fixture associated with a foldable-bed unit, the first bracket mounted rearwardly of the second bracket on the mounting plate and oriented such that the U-shaped slot therein has a non-vertical orientation with respect to the upright position of the article of furniture, the second bracket mounted forwardly of the first bracket and oriented such that the U-shaped slot therein has a generally vertical orientation with respect to the upright position of the article of furniture.

2. The quick-mount mechanism of claim 1, further comprising:

a foldable-bed unit that includes a fixture corresponding to each of the first and second brackets and each fixture has a configuration suitable to slideably couple to the corresponding first and second brackets.

3. The quick-mount mechanism of claim 2, wherein the fixture comprises a flat-head shoulder rivet.

4. The quick-mount mechanism of claim 3, wherein a raised portion of the first and second brackets adjacent to the U-shaped slot is spaced apart from the mounting plate a sufficient distance to accept a head portion of the fixture between the raised portion of the first and second brackets and the mounting plate.

5. The quick-mount mechanism of claim 1, wherein a retaining tab located within the U-shaped slot of one or more of the first and second brackets for retaining the corresponding fixture associated with the foldable-bed unit.

6. The quick-mount mechanism of claim 5, wherein the retaining tab permanently or removeably retains the corresponding fixture associated with the foldable-bed unit.

7. The quick-mount mechanism of claim 5, wherein the retaining tab is integral with the mounting plate.

8. The quick-mount mechanism of claim 5, wherein the retaining tab comprises a spring clip that is installed on the mounting plate.

9. The quick-mount mechanism of claim 1, wherein the first bracket is oriented such that open end of the U-shaped slot therein is tilted toward the second bracket.

10. The quick-mount mechanism of claim 9, wherein the first bracket is oriented such that the open end of the U-shaped slot therein is tilted toward the second bracket at an approximately forty-five degree angle.

11. The quick-mount mechanism of claim 1, wherein the article of furniture comprises one of a sofa, a love seat, a chair-and-a-half, a chair, and a recliner.

12. A method for installing a foldable-bed unit in an article of furniture comprising;

mounting a pair of mounting plates on opposing interior surfaces of a frame of an article of furniture, wherein each of the mounting plates includes a first bracket and a second bracket, the first and second brackets including a U-shaped slot configured to slideably receive a corresponding fixture associated with a foldable-bed unit, the first bracket mounted rearwardly of the second bracket on the mounting plate and oriented such that the U-shaped slot therein has a non-vertical orientation with respect to an upright position of the article of furniture, the second bracket mounted forwardly of the first bracket and oriented such that the U-shaped slot therein has a generally vertical orientation with respect to the upright position of the article of furniture;

slideably inserting a pair of first fixtures of the foldable-bed unit into the U-shaped slots of the first brackets;

rotating the foldable-bed unit about an axis formed by the first fixtures toward the second brackets; and slideably inserting a pair of second fixtures of the foldable-bed unit into the U-shaped slots of the second brackets.

13. The method of claim 12, wherein a retaining tab is included within one or more of the first and second brackets and wherein the first and second fixtures are secured in the one or more first and second brackets respectively by the retaining tabs.

14. The method of claim 12, wherein the fixture comprises a flat-head shoulder rivet.

15. The method of claim 14, wherein a raised portion of the first and second brackets adjacent to the U-shaped slot is spaced apart from the mounting plate a sufficient distance to accept a head portion of the fixture between the raised portion of the first and second brackets and the mounting plate.

16. The method of claim 12, wherein the first bracket is oriented such that the open end of the U-shaped slot therein is tilted toward the second bracket.

17. The method of claim 12, wherein the article of furniture comprises one of a sofa, a love seat, a chair-and-a-half, a chair, and a recliner.

18. The method of claim 12, wherein the foldable-bed unit is in a folded configuration.

19. An article of furniture having a quick-mount mechanism for mounting a foldable-bed unit therein comprising:

a frame providing two cross-members for an article of furniture located near opposite ends of the article of furniture extending from a front portion to a rear portion of the article of furniture and defining ends of a cavity;

a first bracket and a second bracket attached to each of the cross-members on opposing faces of the cross-members and interior to the cavity, the first and second brackets including a raised U-shaped slot having an open upper end configured to slideably accept a fixture of a foldable-bed unit into the U-shaped slot, the first bracket mounted rearwardly of the second bracket on the cross-member and oriented such that the open upper end of the U-shaped slot therein is angled toward the second bracket, the second bracket mounted forwardly of the first bracket and oriented such that the U-shaped slot therein has a generally vertical orientation with respect to an upright position of the article of furniture, one or more of the first and second brackets including a retaining tab located interior to the U-shaped slots therein; and a foldable-bed unit that includes a pair of first fixtures corresponding to each of the first brackets, a pair of second fixtures corresponding to each of the second brackets, and each fixture has a configuration suitable to slideably couple to the corresponding first and second brackets, wherein the foldable-bed unit is installed in the cavity by slideably inserting the pair of first fixtures into the U-shaped slots of the first brackets to engage any retaining tabs therein and rotating the foldable-bed unit about an axis created by the first fixtures to slideably insert the pair of second fixtures into the U-shaped slots of the second brackets and engage any retaining tabs therein.

20. The article of furniture of claim 19, wherein the first and second brackets are attached to the cross-members via a mounting plate positioned between the first and second brackets and the cross-member.

* * * * *